United States Patent [19]

Piazza et al.

[11] 4,273,472

[45] Jun. 16, 1981

[54] APPARATUS FOR PROTECTING SUBSEA WELLS

[75] Inventors: Andre L. Piazza, Houston; Michael J. Krenek, Spring; Thomas J. Ames, Houston, all of Tex.

[73] Assignee: FMC Corporation, San Jose, Calif.

[21] Appl. No.: 952,418

[22] Filed: Oct. 18, 1978

[30] Foreign Application Priority Data

Feb. 20, 1978 [GB] United Kingdom ..... 6720/78

[51] Int. Cl.[3] ..... E02B 17/02; E02D 31/00

[52] U.S. Cl. ..... 405/211; 166/356; 405/169; 405/227

[58] Field of Search ..... 405/60, 169, 195, 211, 405/224, 227, 228, 157; 166/335, 356, 366, 368

[56] References Cited

U.S. PATENT DOCUMENTS

| | | | |
|---|---|---|---|
| 3,556,210 | 1/1971 | Johnson | 166/366 X |
| 3,703,207 | 11/1972 | Horton | 166/356 X |
| 3,770,052 | 11/1973 | Childers | 405/60 X |
| 3,910,056 | 10/1975 | Dopyera | 405/211 |
| 3,999,395 | 12/1976 | Broms et al. | 405/227 |

FOREIGN PATENT DOCUMENTS

| | | | |
|---|---|---|---|
| 7707168 | 12/1977 | Netherlands | 405/157 |
| 749979 | 6/1956 | United Kingdom | 405/227 |

*Primary Examiner*—David H. Corbin

*Attorney, Agent, or Firm*—L. B. Guernsey; W. W. Ritt, Jr.; R. B. Megley

[57] ABSTRACT

Apparatus for protecting subsea structures, and in particular christmas trees from damage by fishing nets, trawl boards, anchors and other marine equipment, include a protective structure which is placed over the christmas tree. The protective structure has an opening in the top portion to allow access to the christmas tree when such access is needed and a protective cap which closes the opening to prevent damage from silt, sand, trash and overhead falling objects. The entire protective structure is secured in place by one or more piles which are driven into the sea floor or by cementing one or more steel piles in place in the sea floor. The protective structure and the cap are guided into place around the well by guide cables attached to the guide base of the well. A lifting device in the protective cap facilitates removal of the cap by a single cable.

5 Claims, 5 Drawing Figures

APPARATUS FOR PROTECTING SUBSEA WELLS

BACKGROUND OF THE INVENTION

1. Field of the Invention

This invention relates to subsea structures, and more particularly, to apparatus for protecting subsea wells from damage by trawl boards and ship anchors.

2. Description of the Prior Art

The production of oil and gas from offshore wells has developed into a major endeavor of the petroleum industry. Wells are commonly drilled throughout the world at a wide variety of locations, some of which are in shipping lanes or areas of high density ship traffic while others are in fishing areas where fishing vessels may pull fishing nets, trawl boards and anchors across wellheads having christmas trees attached thereto. A snagged anchor can literally tear a christmas tree off a wellhead thereby causing dangerous and expensive oil and gas leakage into the sea. Such leaks are not only expensive in terms of repair expense and wasted products but can cause considerable damage to the environment. As a result some governments require protective enclosures of subsea production systems, oil storage areas, manifolds, and christmas trees and other wellhead equipment.

Some of the prior art protective enclosures include installations of concrete, steel and/or fiberglass structures that are simply placed over the christmas tree. These structures may be in the form of domes, pyramids or cone-like shapes that allow the deflection of trawl boards and other objects over the christmas trees.

Most steel and concrete protectors rely on their massive weight to retain them in position when they are positioned on the sea floor. Since the christmas tree of a well can protrude 20 to 30 feet above the sea floor, a protective structure such as a steel pyramid may be as tall as 30 feet with a base as large as 50 to 60 feet in diameter, and with a total weight approaching or exceeding 200,000 lbs. The lighter fiberglass structures require some means of anchoring the structures to the sea floor. In some of the prior art installations, this has been accomplished with screw-type anchors positioned around the fiberglass structure. Furthermore, the physical size of all these structures makes their handling and installation difficult.

It is important that the problems of handling the large protective structures and of securing them in position around the subsea christmas trees be reduced. A structure which covers the christmas tree and relies upon its own weight to prevent displacement by moving trawl board or anchors is too large and cumbersome to be conveniently installed.

SUMMARY OF THE INVENTION

The present invention comprises a deflecting structure having an opening in the upper portion thereof to provide access to the well when the deflecting structure is in place around the well. One or more supporting piles are placed in the sea floor and the deflecting structure is connected to the piles to secure the deflecting structure in place. Since the piles prevent the deflecting structure from moving the structure can be lighter in weight and easier to handle and install than prior art structures. A protective cap is placed over the opening to prevent damage to the well from overhead falling objects. The deflecting structure and the protective cap can each be guided into position by the guidelines which are used to position the christmas tree and other wellhead apparatus.

DESCRIPTION OF THE PREFERRED EMBODIMENT

Figure 1:
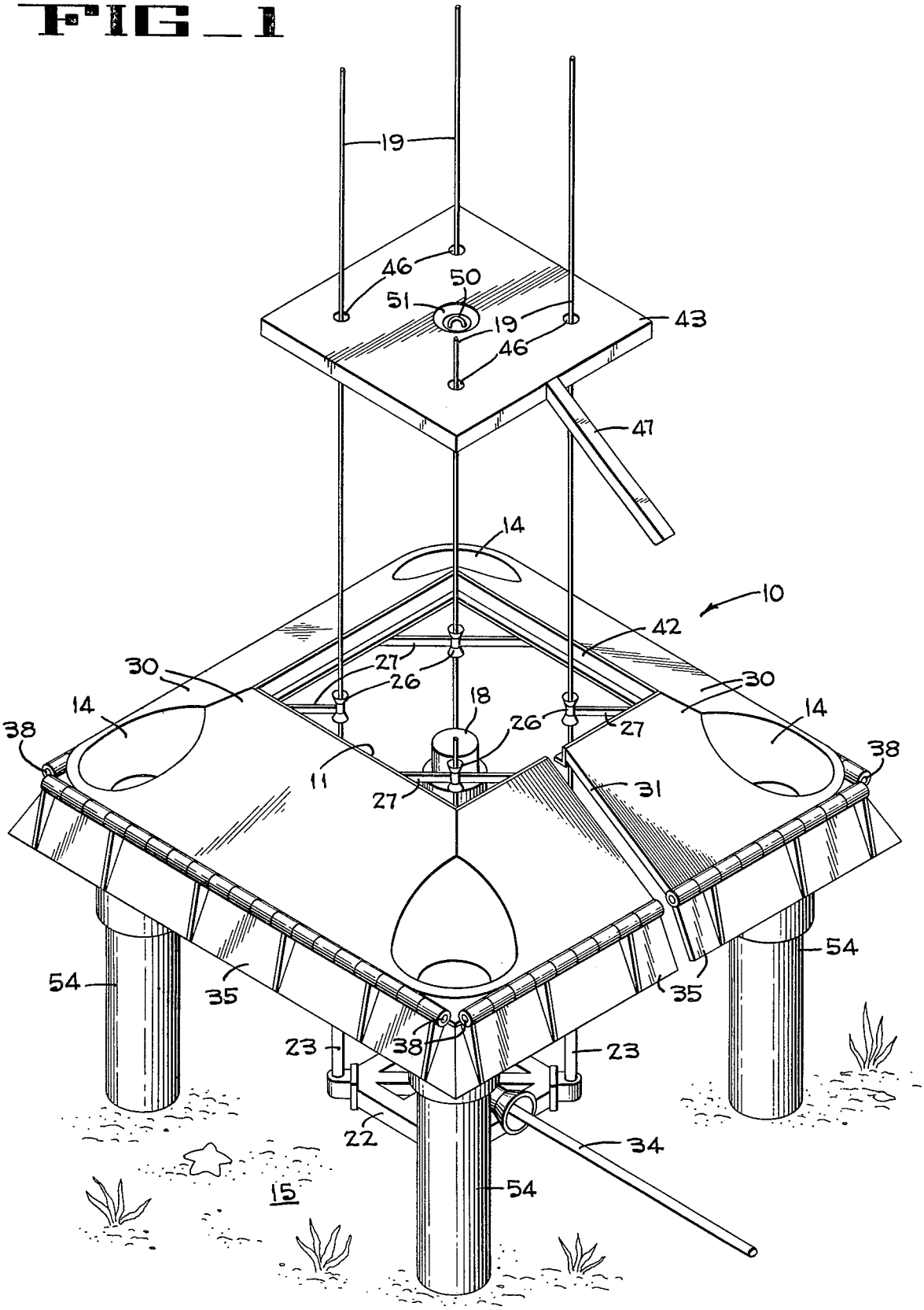
FIG. 1 is an isometric view of an apparatus for protecting subsea wells according to the present invention.
Figure 4:
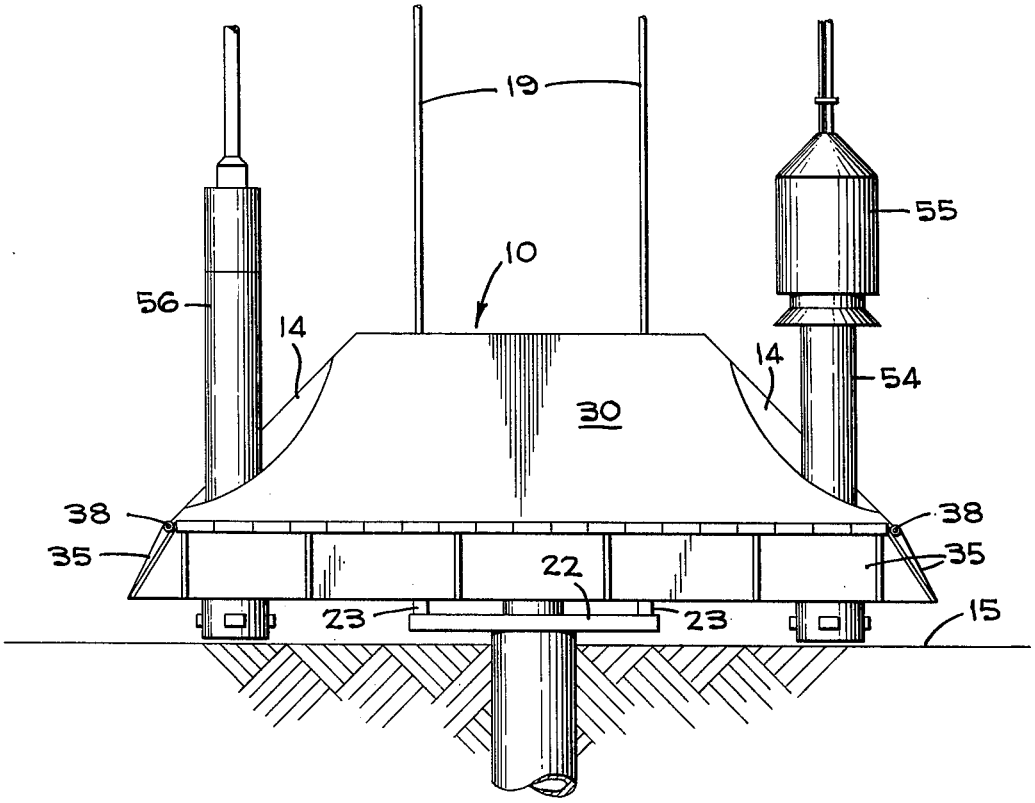
FIG. 4 is a side elevation of the apparatus of FIG. 1 illustrating the apparatus for installing the piles.

Apparatus for protecting subsea wells of the present invention comprises a deflecting structure 10 (FIGS. 1 and 4) having an opening 11 in the top portion of the structure to allow access to the well and having a plurality of pile slots 14 for guiding piles into the sea floor 15. The deflecting structure 10 is guided into position around a christmas tree 18 by a plurality of guidelines 19 connected between a surface vessel (not shown) and a guidebase 22 (FIG. 1) having a plurality of guide posts 23. The lower end of each of the guidelines 19 is connected to one of the guideposts 23. A plurality of spool-like guides 26 each connected to the deflecting structure 10 by a bracket 27 cooperates with the guidelines to guide the structure 10 into position as it is lowered toward the sea floor 15.

Figure 2:
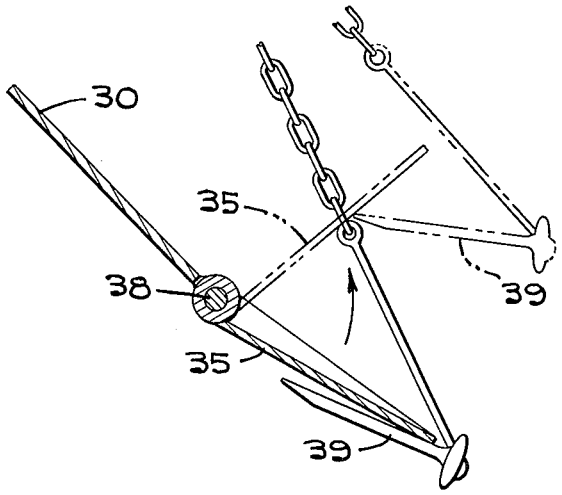
FIG. 2 is a side elevation of a portion of the apparatus of FIG. 1 showing an anchor deflecting portion of the apparatus.

The sides 30 (FIG. 1) of the deflecting structure incline to form a roof over the christmas tree 18. A flowline slot 31 in one of the sides facilitates the connection of a flowline 34 to the christmas tree after the deflecting structure is in position. At the lower end of the sides 30 a plurality of skirt-like anchor deflectors 35 (FIGS. 1 and 2) are pivotally attached by a plurality of pins 38. These deflectors 35 are designed to swing upward (FIG. 2) and release a snagged anchor fluke 39 allowing the anchor to slide over the deflector roof.

A shoulder 42 around the opening 11 supports a protective cap 43 (FIG. 1) which is guided into position by the guidelines 19, extending through the holes 46 in the cap. The protective cap prevents damage from overhead falling objects and also prevents anchors from snagging on the sides adjacent the opening 11. A flowline slot cover 47 attached to the cap 43 fits into the slot 31 to prevent objects from snagging in the slot 31. A lifting device 50 mounted in a recess 51 can be connected to a cable (not shown) for lifting the cap 43 from the opening 11 to permit service of the christmas tree 18.

After the deflecting structure 10 has been lowered into position (FIG. 4) on the guidelines 19 a pile 54 can be inserted into each of the pile slots 14 (FIGS. 1 and 4) and driven into the sea floor 15 by a pile hammer 55 to anchor the structure 10 in place. Another method of anchoring the structure 10 in position is to lower a drill string 56 (FIG. 4) into the slot 14 and drill a hole in the sea floor 15. The drill string is returned to the surface where it is attached to a pile and then lowered back into the slot 14 and into the previously drilled hole. Cement is then pumped down the drill string into the drilled hole between the drill string and the steel pile. Anchor piles can also be installed by the use of conventional jetting techniques.

Figure 3:
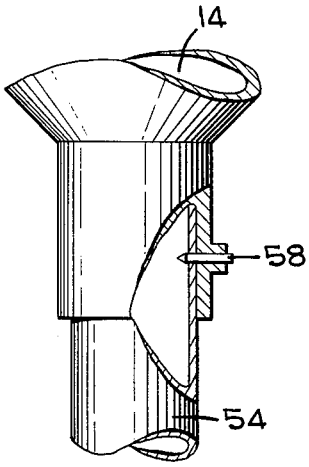
FIG. 3 is an enlarged side elevation, with portions broken away, of apparatus for attaching a pile guide to a pile.

After the piles 54 are in place it may be desirable to raise the structure a distance above the sea floor (FIG. 1) and secure the structure 10 in this position by any suitable means. One such means is illustrated in FIG. 3 wherein a pin 58 is mounted in the wall of the pile slot 14. The pin can be driven into the pile 54 by a pyrotechnic hammer (not shown). A protective structure which is supported above the sea floor can be considerably smaller and lighter in weight than a structure which rests on the sea floor and covers the subsea well and christmas tree.

Alternate Embodiment of the Invention

Figure 5:
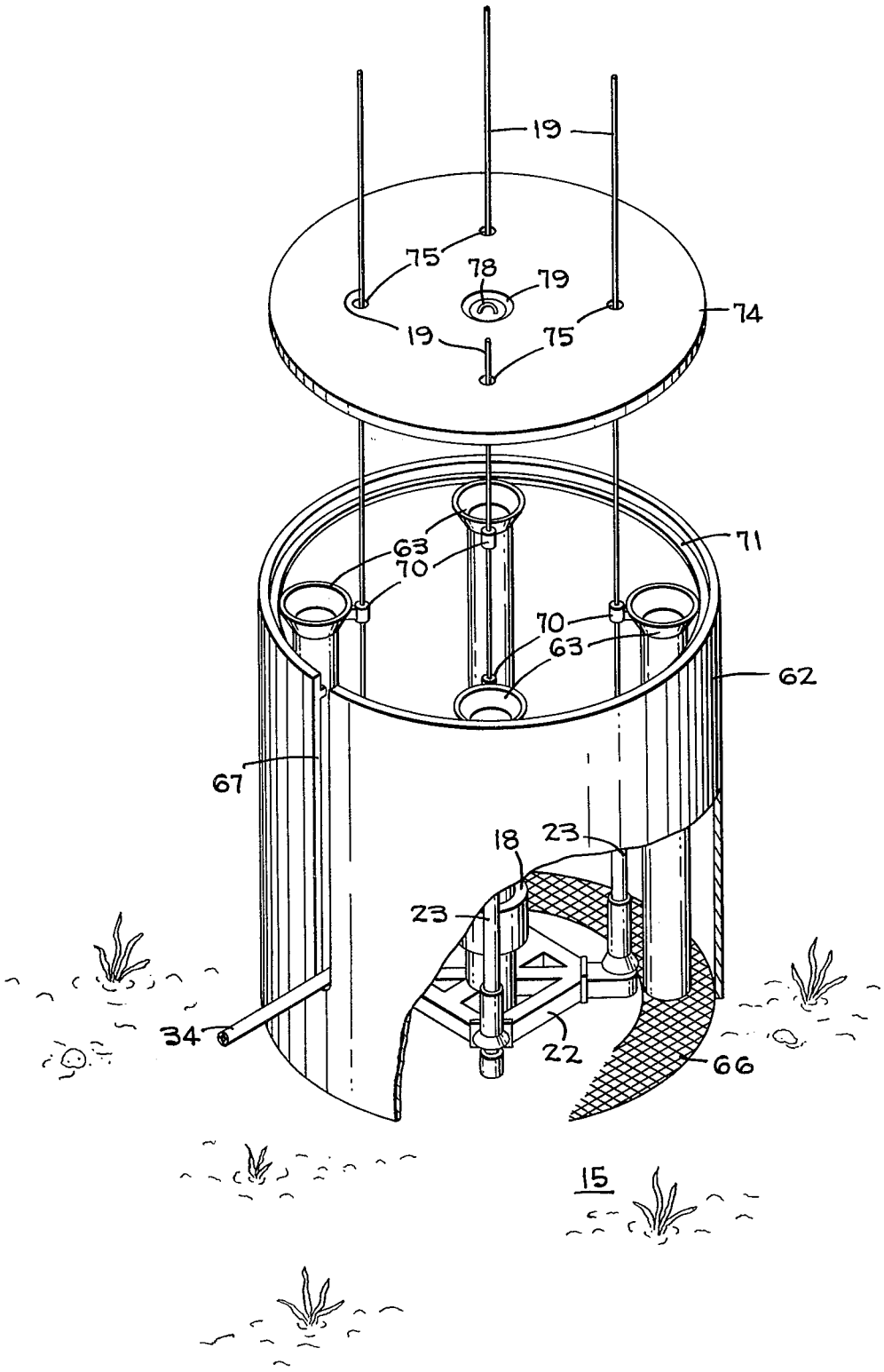
FIG. 5 is an isometric view of another embodiment of the apparatus for protecting subsea wells according to the present invention.

Another embodiment of the invention (FIG. 5) comprises a fabricated cylindrical deflector 62 open at each end and having a plurality of tubular pile guides 63 fastened to the wall of the deflector 62. The pile guides can be on the inside of the deflector as shown or they can be fabricated on the outside if desired. A mud pad 66 connected to the lower end of the deflector, prevents the deflector from sinking too far into soft soils. A flowline slot 67 in the side of the deflector 62 is positioned to allow a standard flowline 34 to be connected to the christmas tree 18. A plurality of cable guides 70 connected to the pile guides cooperate with the guide lines 19 to direct the deflector 62 into position as it is lowered to the sea floor 15.

The deflector 62 (FIG. 5) is anchored to the sea floor by a plurality of piles which are driven through the pile guides 63 and fastened by any suitable means such as the pin 58 shown in FIG. 3. A shoulder 71 around the upper end of the deflector 62 supports a protective cap 74 (FIG. 5) which is guided into position by the guidelines 19 extending through the holes 75 in the protective cap. A lifting device 78 mounted in a recess 79 can be connected to a cable (not shown) for lifting the cap 74 from the deflector to permit access to the christmas tree 18.

While only rectangular and cylindrical structures are disclosed in the drawings of FIGS. 1–5 other shapes of deflecting structures can be used.

The present invention discloses protective apparatus which is anchored to the sea floor by piles or cement to permit relatively light structures to be firmly held in a protective position over a subsea christmas tree and/or wellhead. The deflecting structure and a protective cap can be guided into operating position by the same guidelines which are used for installing other wellhead equipment.

Although the best mode contemplated for carrying out the present invention has been herein shown and described, it will be apparent that modification and variation may be made without departing from what is regarded to be the subject matter of the invention.

What is claimed is:

1. Apparatus for protecting subsea structures on the sea floor from physical damage caused by nets, anchors and other marine equipment, said apparatus comprising:

a deflecting structure for mounting over said subsea structures, said deflecting structure including an inclined roof portion, a skirt-like anchor deflector and means for pivotally connecting said anchor deflector to a lower portion of said roof portion, said deflecting structure having an opening in the upper portion thereof for access to said subsea structure;

at least one supporting pile placed in said sea floor to secure said deflecting structure in place;

means for connecting said deflecting structure to said supporting pile; and a protective cap for mounting in said opening of said deflecting structure.

2. Apparatus for protecting subsea structures as defined in claim 1 including means for securing said protective cap in said opening of said deflecting structure.

3. Apparatus for protecting subsea structures as defined in claim 1 including means for supporting said deflecting structure a predetermined distance above the sea floor.

4. Apparatus for protecting subsea structures as defined in claim 1 wherein said deflecting structure includes a slot in one side thereof to facilitate the connection of a flowline to a christmas tree atop a subsea well.

5. Apparatus for protecting subsea structures defined in claim 1 including guide means for directing said deflecting structure into position over said subsea structures.

* * * * *